US008579669B2

(12) United States Patent
Sjöblom et al.

(10) Patent No.: US 8,579,669 B2
(45) Date of Patent: Nov. 12, 2013

(54) GEAR HOUSING FOR AN AQUATIC VESSEL, BREAKAWAY SAFETY SYSTEM FOR AN AQUATIC VESSEL AND AQUATIC VESSEL

(75) Inventors: Lars Sjöblom, Västra Frölunda (SE); Mathias Aström, Göteborg (SE); Lennart Sellman, Onsala (SE); Mikael Asberg, Askim (SE)

(73) Assignee: AB Volvo Penta, Göteborg (SE)

( * ) Notice: Subject to any disclaimer, the term of this patent is extended or adjusted under 35 U.S.C. 154(b) by 78 days.

(21) Appl. No.: 12/990,499

(22) PCT Filed: May 23, 2008

(86) PCT No.: PCT/SE2008/000346

§ 371 (c)(1),
(2), (4) Date: Oct. 30, 2010

(87) PCT Pub. No.: WO2009/142553

PCT Pub. Date: Nov. 26, 2009

(65) Prior Publication Data

US 2011/0056329 A1 Mar. 10, 2011

(51) Int. Cl.
*B63H 5/125* (2006.01)
*B63H 20/08* (2006.01)

(52) U.S. Cl.
USPC ..... 440/56

(58) Field of Classification Search
USPC ..... 440/49–53, 55, 56, 76, 78, 79, 82
See application file for complete search history.

(56) References Cited

U.S. PATENT DOCUMENTS

| | | | | |
|---|---|---|---|---|
| 1,943,288 | A * | 1/1934 | Svendsen et al. | 440/56 |
| 2,917,019 | A | 12/1959 | Kruegar | |
| 3,151,597 | A * | 10/1964 | Larsen | 440/71 |
| 6,315,623 | B1 * | 11/2001 | Hedlund | 440/56 |
| 6,966,806 | B1 * | 11/2005 | Bruestle et al. | 440/78 |
| 7,188,581 | B1 | 3/2007 | Davis et al. | |

(Continued)

FOREIGN PATENT DOCUMENTS

| | | | |
|---|---|---|---|
| JP | 2004314824 | A2 | 11/2004 |
| WO | 9935034 | A1 | 7/1999 |

(Continued)

OTHER PUBLICATIONS

International Search Report for corresponding International App. PCT/SE2008/000346.

(Continued)

*Primary Examiner* — Daniel Venne
(74) *Attorney, Agent, or Firm* — WRB-IP LLP

(57) ABSTRACT

A gear housing for an aquatic vessel is adapted to be attached at an attachment site to an underside of a hull of the aquatic vessel. The gear housing includes at least one weakened region adapted to yield when the gear housing is rotated at the attachment site following an impact. A breakaway safety system includes such a gear housing, and a fracturable member for attaching the gear housing to the hull at the attachment site, wherein the weakened region is adapted to yield such that the fracturable member fractures. An aquatic vessel includes such a gear housing or such a breakaway safety system.

12 Claims, 5 Drawing Sheets

(56) References Cited

U.S. PATENT DOCUMENTS

| | | | | |
|---|---|---|---|---|
| 7,867,046 | B1 * | 1/2011 | Eichinger | 440/56 |
| 8,011,983 | B1 * | 9/2011 | Davis et al. | 440/56 |
| 8,062,082 | B1 * | 11/2011 | Anderson et al. | 440/56 |

FOREIGN PATENT DOCUMENTS

| | | | |
|---|---|---|---|
| WO | 0226558 | A1 | 4/2002 |
| WO | 2006005556 | A1 | 1/2006 |
| WO | 2009096823 | A1 | 8/2009 |

OTHER PUBLICATIONS

JPHO061689 U (Aug. 30, 1994).

European Search Report (Dec. 10, 2012) for corresponding European App. EP 08 76 7040.

* cited by examiner

GEAR HOUSING FOR AN AQUATIC VESSEL, BREAKAWAY SAFETY SYSTEM FOR AN AQUATIC VESSEL AND AQUATIC VESSEL

BACKGROUND AND SUMMARY

The present invention relates to a gear housing for an aquatic vessel, said gear housing being adapted to he attached at an attachment site to an underside of a hull of said aquatic vessel. The invention also relates to a breakaway safety system for an aquatic vessel, said breakaway safety system comprising such a gear housing. Finally the invention relates to an aquatic vessel comprising a gear housing and an aquatic vessel comprising a breakaway safety system.

Various types of propeller-driven aquatic vessels, such as yachts, ships or boats, are known. Such vessels comprise at least one hull and at least one propulsion arrangement supported by said hull. The propulsion arrangement comprises an engine assembly providing motive power to a propeller assembly adapted to be submerged in water when the vessel is in operation. The propeller assembly comprises at least one propeller shaft, which is coupled to said engine assembly via a transmission shaft. A propeller mounted on said propeller shaft propels the vessel through the water when the engine is running. The propeller assembly is at least partially accommodated in a gear housing attached to the underside of the hull.

It is known to provide the gear housing with some sort of sacrificial mechanical structure, to protect the propeller assembly in the event of an impact with a submerged object. For example, U.S. Pat. No. 6,966,806 discloses a gear housing provided with a replaceable leading edge portion configured to absorb energy during impact. It is also known to include sacrificial mechanical structures to prevent damage occurring to the hull.

These sacrificial structures are however not adapted to protect vessels equipped with larger and more powerful propulsion arrangements. For example, contemporary yachts are sometimes equipped with two engine assemblies each delivering about 660 kW and sometimes as much as 1000 KW. Such vessels are in an impact situation subject to large forces susceptible to cause considerable damage to the vessels.

It is thus desirable to provide a gear housing which better protects an aquatic vessel in the event of an impact.

It is desirable to provide a breakaway safety system which better protects an aquatic vessel in the event of an impact.

It is desirable to provide an aquatic vessel which is better protected in the event of an impact.

According to an aspect of the present invention, a gear housing for an aquatic vessel is provided, said gear housing being adapted to be attached at an attachment site to an underside of a hull of said aquatic vessel. The gear housing comprises at least one weakened region adapted to yield when said gear housing is rotated at said attachment site following an impact.

A gear housing has a longitudinal direction, a height direction and a width direction and exhibits a first end arranged to face in a forward direction when the vessel is propelled forward, and a second end opposite to said first end, which second end is arranged to face in a backward direction when the vessel is propelled forward. The gear housing further exhibits an upper side adapted to face the hull when the gear housing is attached thereto and a lower side opposite to side upper side, which lower side is adapted to face away from the hull when the gear housing is attached thereto. When the first end of the gear housing collides with a submerged object, the impact will cause the gear housing to rotate around an axis extending in the width direction such that the second end of the gear housing is forced up against the hull. Such a Collision may cause considerable damage to the hull. According to the present invention, this problem is solved by providing the gear housing with at least one weakened region that will yield and collapse before the hull and thus allows the gear housing to rotate without damaging the hull. Moreover, the rotation and collapse of the gear housing leads to a concentration of forces to the attachment site that advantageously causes the gear housing to break away from the hull before it inflicts severe damage thereto. To facilitate the break-away of the gear housing, the gear housing is advantageously but not necessarily attached to said hull via a fracturable member.

The weakened region is advantageously located at the upper side of the gear housing, extending in the longitudinal direction from the second end. However, other locations are conceivable as long as the weakened region allows the impact receiving part of the gear housing to rotate relative the hull without causing severe damage thereto. The weakened region may, for example, be located at the centre of the gear housing as seen in the longitudinal direction, extending from the upper side towards the lower side.

The weakened region may be of any suitable shape, for example triangular or rectangular, and is preferably arranged such that it has a large extent where a large displacement of the gear housing is expected in an impact situation.

Seen in the width direction, a part of the gear housing arranged to collapse at an impact comprises either a single wall or a plurality of walls, and the weakening of the weakened region can, for example, be achieved by providing one or more of said walls with one or more recesses, each defining a zone that is thinner and weaker than the rest of the wall. This solution is advantageous in that such walls are easily created at low production costs. It is also advantageous if the recesses are arranged at a distance from one another, so that areas of high strength extending in a first direction at an angle, and most preferably perpendicular, to the direction of the impact force, remain between said recesses, providing stability to the gear housing. in said first direction. Said areas may, for example, provide stability to the gear housing in the longitudinal direction.

The weakened region may also comprise an area made of a material of lower strength in comparison with the rest of the gear housing. A portion of a gear housing wall may, for example, undergo various treatments, for example heat treatment, that reduce the strength of the wall material. Alternatively, at least one portion of a wall may be replaced with a substitute piece made of a low strength material suitable for thin walls. The gear housing may, for example, be made of bronze and the substitute piece of plastic, aluminum or stainless steel. The substitute piece is easily attached to the gear housing, for example by means of an adhesive or fasteners, such as rivets or screws, or by welding or press fitting. The latter solution is advantageous in that it effectively reduces the strength of the weakened region and in that it also reduces material costs and the total weight of the gear housing. Furthermore, the substitute piece is easily attached to the gear housing in such a way that it does not negatively affect the flow resistance. Most advantageous is if the entire weakened region consists of or comprises only one substitute piece, as this facilitates the mounting procedure.

The weakened region may also comprise a large aperture in the gear solution, which further reduces the strength and total weight of the gear housing. However, this is not a preferred embodiment as such a large aperture detracts from the stability of the gear housing, A reduction of the strength and weight of the gear housing is also achieved with a weakened region comprising one or more hollow portions.

If the weakened region comprises one or more recesses then the recesses are advantageously situated so that they cause minimal flow resistance. Accordingly, if the gear housing comprises a compartment defined by opposite side walls, for example a passageway for exhausts from the engine assembly, then the recesses are advantageously formed in the inside surfaces of said side walls. However, the recesses can also be formed in the outside surfaces of the gear housing, in which case the recesses advantageously are tilled with a low strength material, such as plastic, in order to minimize the flow resistance without substantially increasing the strength of the weakened region.

In some embodiments, the gear housing further comprises a tail region located towards the second end of the gear housing, where said side walls meet to define a region of increased strength. It is therefore advantageous if the above described recesses or substitute piece are extended all the way to the second end. An alternative, simple and inexpensive solution is to provide said tail region with an indication of fracture dividing said tail region into a first and a second part in the height direction, said first part exhibiting an oblique surface facing an oblique surface on said second part such that said first and second parts are adapted to slide past one another in the event of an impact. The indication of fracture could, for example, be a slit or recess in the tail region or a substitute piece made of a low strength material.

The weakened region advantageously consists of or comprises one or more weakenings arranged in a pattern so as to form a more or less continuous weakening when projected on an axis extending in the longitudinal direction of the gear housing, to ensure that the entire weakened region collapses when subjected to an impact force.

According to another aspect of the present invention, a breakaway safety system for an aquatic vessel is provided, said aquatic vessel comprising a hull, and said breakaway safe system comprising a gear housing and a fracturable member for attaching said gear housing to said hull at an attachment site. The gear housing comprises at least one weakened region adapted to yield when said gear housing is rotated at said attachment site following an impact. The consequence of this collapse of the gear housing is a concentration of forces to the fracturable member, which causes the fracturable member to fracture, so that the gear housing falls of the hull without causing considerable damage thereto.

According to another aspect of the present invention, an aquatic vessel comprising such a gear housing or a vessel comprising such a breakaway safety system is provided.

BRIEF DESCRIPTION OF THE DRAWINGS

In the following text, the invention will be described in detail with reference to the attached drawings. These drawings are used for illustration only and do not in any way limit the scope of the invention. In the drawings.

DETAILED DESCRIPTION

In the following, reference is made to an aquatic vessel. The aquatic vessel is susceptible to being implemented, for example, as a yacht, ship or boat.

Reference is also made to a weakened region. As explained below, the weakened region does not have to be of uniform strength and may comprise areas of different strength.

Finally, the term "attached to" should not be interpreted as meaning only "directly attached to". An object can be attached to another object via en intermediate member.

Figure 1:
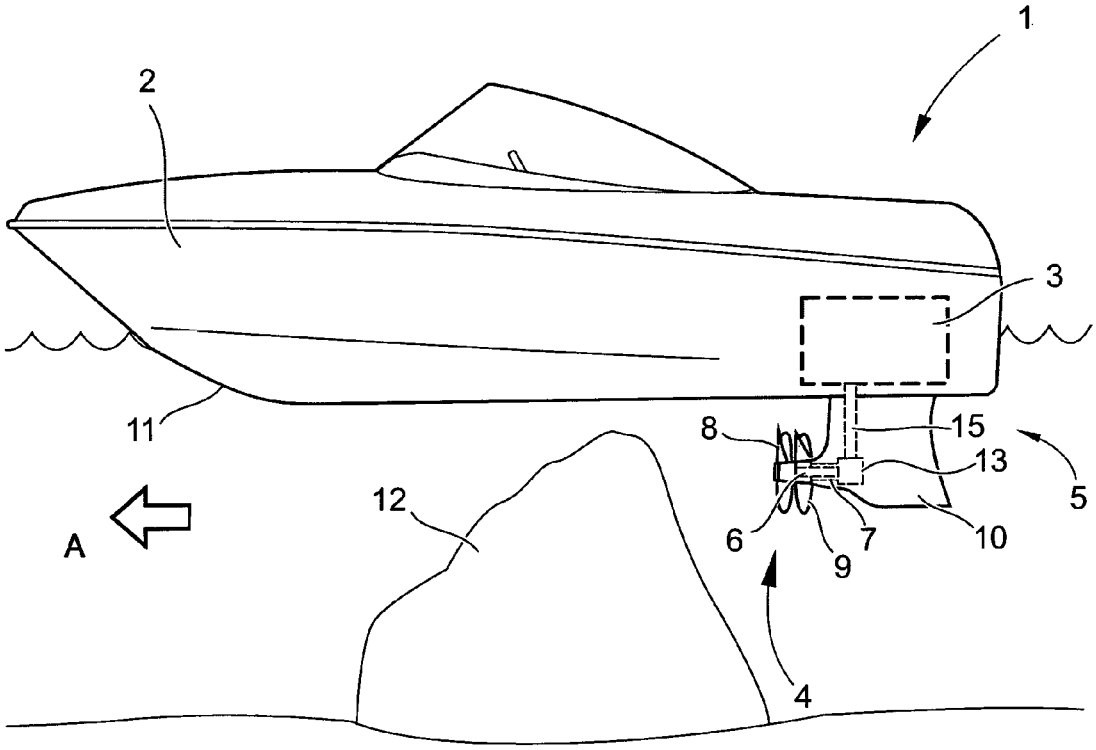
FIG. 1 is a side view of an aquatic vessel comprising a gear housing according to the invention.

Now, with reference to FIG. 1, there is shown an aquatic vessel 1 immersed in a body of water. The vessel 1 comprises a hull 2 and is equipped with a propulsion arrangement 5 implemented to pull the vessel 1 through the water. The propulsion arrangement 5 comprises an engine assembly 3 located towards a rear end of the vessel 1 and a propeller assembly 4 located below the hull 2. In the embodiment shown in FIGS. 1 and 2, the propeller assembly 4 comprises two counter-rotating propellers 8, 9 mounted on first and second coaxial propeller shafts 6, 7, respectively, which propeller shafts 6, 7 are coupled to receive rotary movement from the engine assembly 3 via an intermediate transmission unit 13 and a transmission shaft 15. The propeller shafts 6, 7, the transmission shaft 15 and the transmission unit 13 are at least partially accommodated in a lower gear housing 10, hereinafter referred to as the gear housing 10, attached to an underside 11 of the hull 2 at an attachment site via a fracturable member (not shown in FIG. 1). In principle, the gear housing 10 acts as a stabilizing rudder for the vessel and has a hydrodynamic shape adapted to minimize the flow resistance. The propeller shafts 6, 7 extend from the transmission unit 13 in a forward direction of the vessel 1, indicated by arrow A, so that the propellers 8, 9 are located in front the gear housing 10. However, other propulsion arrangements, for example an arrangement with propeller shafts extending in a rearward direction of the vessel, are conceivable within the scope of the invention.

As can be seen in FIG. 1, the vessel 1 is about to collide with a submerged obstacle 12 in the form of a rock.

Figure 2:
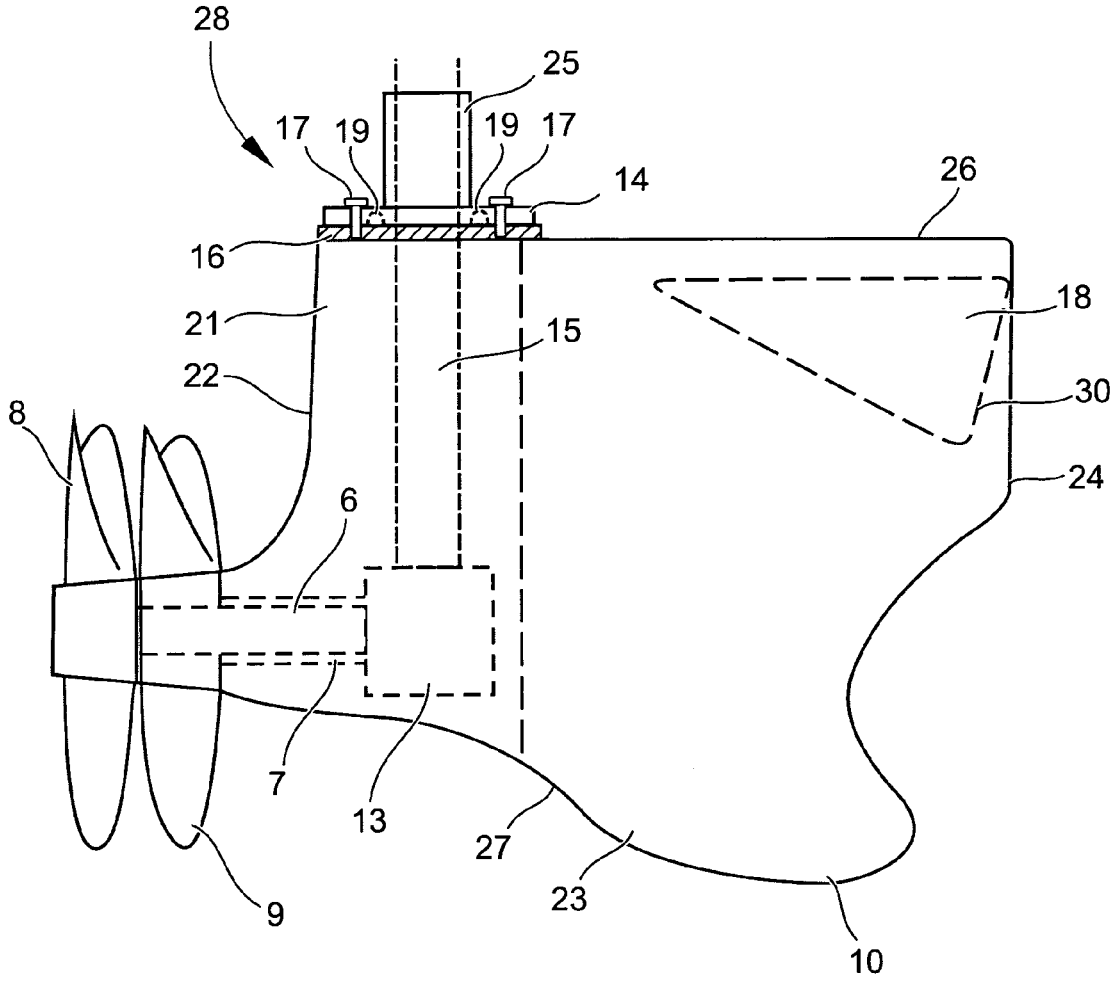
FIG. 2 is a side view of a first embodiment of the gear housing in FIG. 1.

With reference to FIG. 2, there is shown a side view of a break away safety system comprising a first embodiment of the gear housing 10 shown in FIG. 1 and a fracturable member 14 for attaching said gear housing to the hull 2. The gear housing 10 has a longitudinal direction, a height direction and a width direction and comprises a first portion 21 exhibiting a first end 22 arranged to face in a forward direction when the vessel 1 is driven forward, and a second portion 23 exhibiting a second end 24 arranged to face in a backward direction when the vessel 1 is driven forward. Moreover, the gear housing 10 has an upper side 26 facing the hull 2 and a lower side 27 facing away from the hull. The propeller shafts 6, 7, the transmission unit 13 and the transmission shaft 15 are all located in the first portion 21 of the gear housing 10.

The first portion 21 comprises a mounting plate 16, which is attached at an attachment site 28 by means of fasteners 17, for example threaded bolts, to an intermediate housing 25. The intermediate housing 25 is attached to the hull 2 and constitute an intermediate member between the gear housing 10 and an upper gear housing (not shown). In order to avert damage from occurring to the hull 2 in the event of an impact, the intermediate housing 25 includes a fracturable member 14 comprising a rounded annular recess 19 defining a relatively thin annular fracture zone adapted to fracture in the event of an impact with the obstacle 12, so that the gear housing 10 is released from the vessel 1 without causing damage thereto. For the same reason, the transmission shaft 15 is disconnectably enmeshed into the transmission unit 13.

The gear housing 10 further comprises a weakened region 18, schematically indicated by a dashed line 30, adapted to yield before the rest of said gear housing 10, and in particularly before the hull 2. The weakened region 18 is located at the upper side 26 of the gear housing 10, extending from the second end 24 in the longitudinal direction of said gear housing 10 towards said first end 22. The coming collision with the obstacle 12 will cause the gear housing 10 to rotate around a centre of rotation located at the upper side 26. This rotation will force the second portion 23 of the gear housing 10 towards the hull 2, causing a collapse of the weakened region 18. The collapse of the weakened region 18 thus prevents the gear housing 10 from causing severe damage to the hull 2. Moreover, as the collapsible weakened region allows relatively unrestricted rotary movement of the gear housing 10, the impact forces are concentrated to the attachment site 28 and the fracturable member 14, causing the fracturable member 14 to break. Consequently, the gear housing 10 is separated from the hull 2 before it may cause damage thereto. Note that the intermediate housing 25 is sealingly attached to the hull 2 so that no water flows into the vessel when the gear housing 10 is separated from it.

As seen in FIG. 2, the weakened region 18 has an essentially triangular shape and is arranged such that the wide end thereof is located at the second end 24 of the gear housing 10, where a large displacement of the gear housing 10 is expected.

Other locations are of course conceivable for the weakened region, as long as its collapse allows the gear housing, or the portion of the gear housing receiving said impact, to rotate relative the hull without causing severe damage thereto. The same is true for the shape and extent in all directions of the weakened region.

Figure 3:
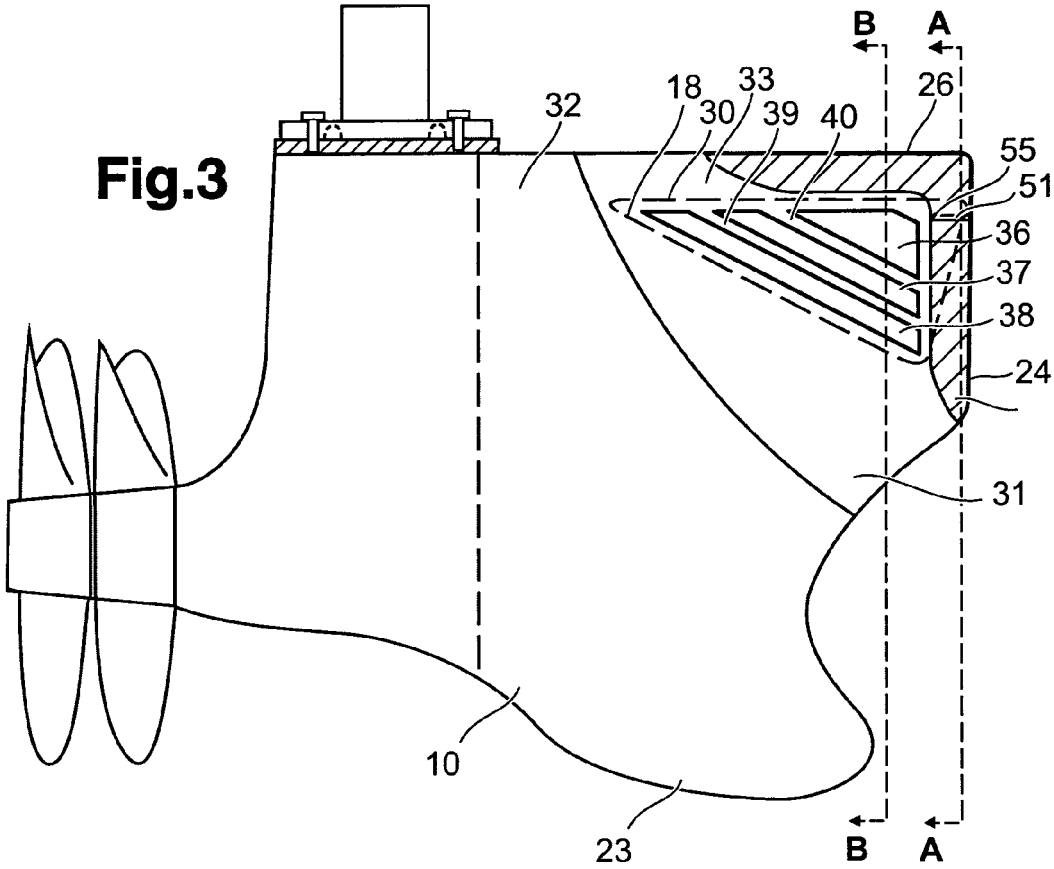
FIG. 3 is a side view of a the gear housing in FIG. 2, wherein a portion of the gear housing has been removed.
Figure 4A:
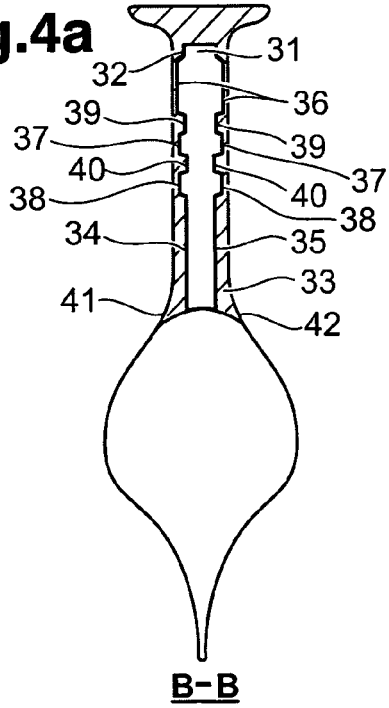
FIG. 4*a* is a section view along the line A-A in FIG. 3.

The weakened region will now be described in greater detail with reference to FIGS. 3, 4*a* and 4*b*, wherein the weakened region 18 is shown comprising recesses 36, 37, 38 and a slit 51. A compartment 31 that serves as a passageway for exhausts from the engine assembly is located in the second portion 23 of the gear housing 10. As shown in FIG. 4*a*, the compartment 31 is defined by opposing side walls 32, 33 and each side wall 32, 33 has an inside surface 34, 35 facing the opposing side wall and an outside surface 41, 42 facing away from the opposing side wall. Three recesses 36, 37, 38 are formed in each inside surface 34, 35, each recess 36, 37, 38 defining a zone of reduced thickness and strength. Now referring to FIG. 3, wherein a portion of one of the side walls 32 has been removed to expose the inside surface 35 of the opposing side wall 33, it is shown that two of the recesses 37, 38 have an elongated shape and run diagonally from near the upper side 26 of the gear housing 10 towards the second end 24 thereof, while the third recess 36 has an essentially trapezoid shape and is located between the nearest one of the two elongated recesses 37, the upper side 26 of the gear housing 10 and the second end 24 of the gear housing 10. It is also shown that said recesses 36, 37, 38 are located at a distance from one another, so that there remain continuous areas of high strength 39, 40 between said recesses 36, 37, 38. These areas of high strength 39, 40 provide stability to the gear housing 10 in the longitudinal direction of the gear housing 10, without significantly increasing the strength of the weakened region 18 in the direction of the rotational movement of the gear housing 10 in an impact situation. Note that the recesses 36, 37, 38 form a continuous weakening when projected on an axis extending in the longitudinal direction of the gear housing 10, and thus ensure that the entire weakened area will collapse in the event of a collision.

Figure 4B:
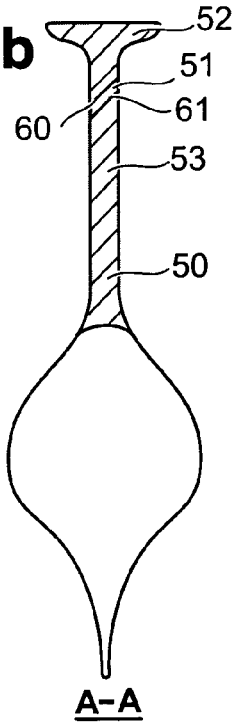
FIG. 4*b* is a section view along the line B-B in FIG. 3.

Now referring to FIG. 4*b*, the side walls converge and meet to define a tail region 50 of high strength at the second end 24 of the gear housing 10, which tail region 50 is provided with an indication of fracture 51 in the form of a slit connecting the outside surfaces of the gear housing 10. The slit 51 divides the tail region 50 into a first and a second part 52, 53 located above one another in the height direction and exhibiting opposing, oblique surfaces 60, 61. Seen in the width direction of the gear housing 10, the slit 51 is oriented at an oblique angle to an axis extending in said width direction, so that the first and second parts 52, 53 are arranged to slide past one another in the event of an impact. In this way, the tail region 50 is prevented from causing damage to the hull 2 in a collision.

Figure 5:
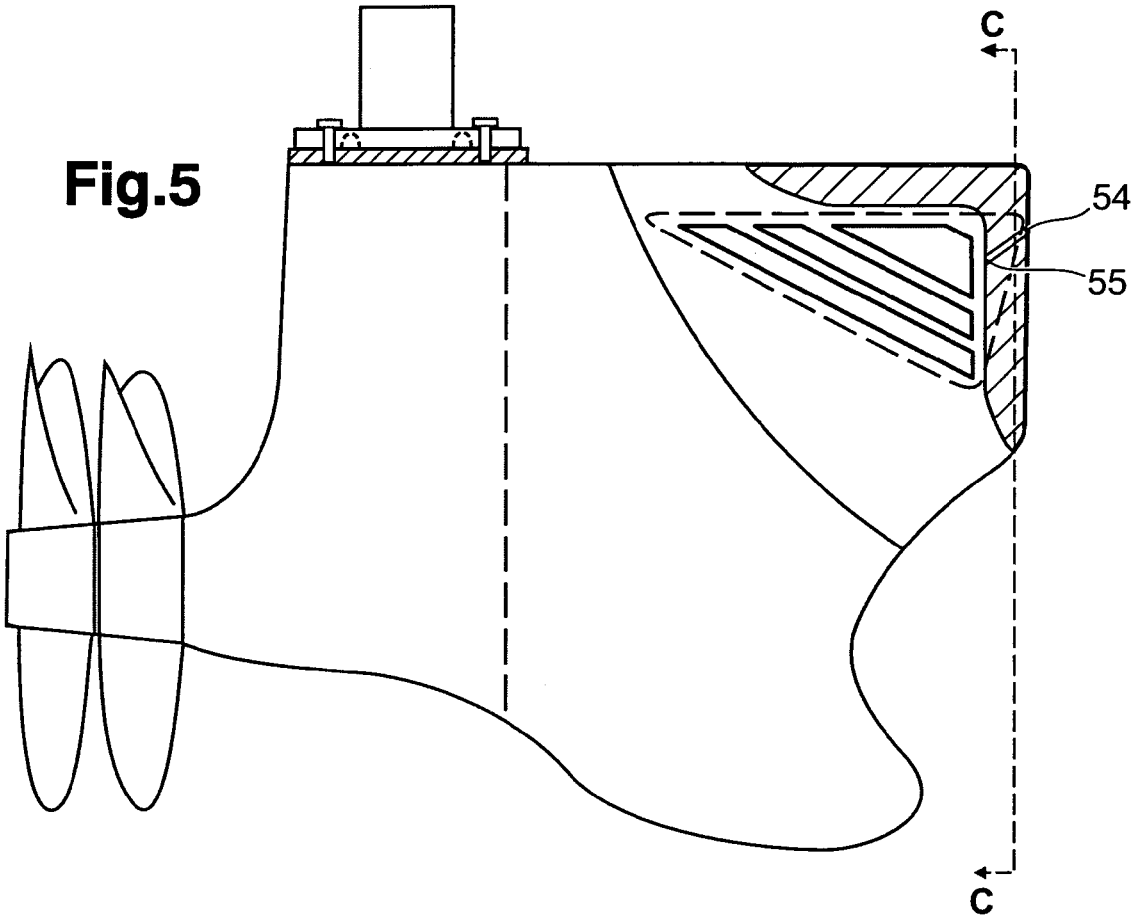
FIG. 5 is a side view of a second embodiment of the gear housing in FIG. 1.
Figure 6:
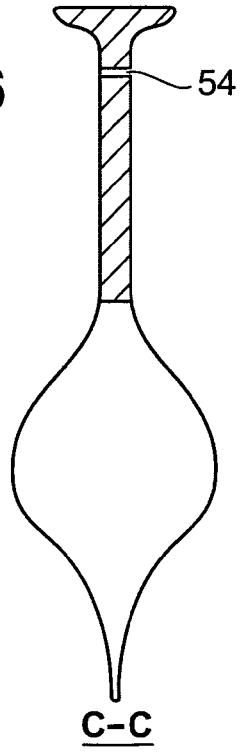
FIG. 6 is a section view along the line C-C in FIG. 5.

With reference to FIGS. 5 and 6 there is shown a break away safety system comprising a second embodiment of the gear housing 10 shown in FIG. 1, which second embodiment is identical to the first embodiment except that the slit 54 has a slightly different orientation. In FIGS. 5 and 6, the slit 54 is oriented at an oblique angle to an axis extending in said longitudinal direction, as seen in said longitudinal direction.

Note that the slits 51 , 54 shown in FIGS. 4*b* and 5 has such an extension in the width direction of the gear housing 10 that they connect the outside surfaces of the gear housing 10. The slits 51, 54 also has such an extension in the longitudinal direction of the gear housing 10, that a partition wall 55 remains between the slits 51, 54 and the compartment 31, to prevent exhausts from escaping through the slits 51, 54. Alternatively, the slits 51, 54 may be extended all the way into the compartment and then made airtight using a suitable sealing material.

Figure 7:
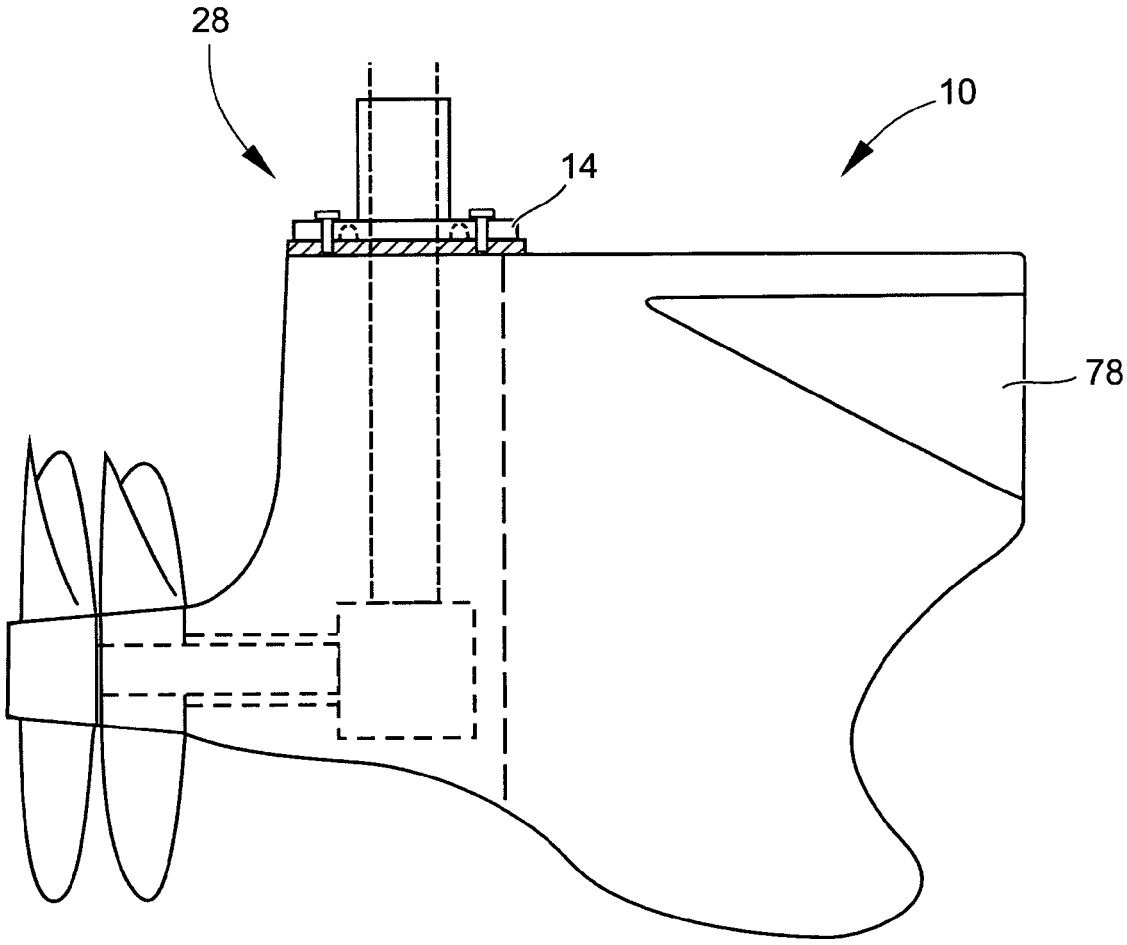
FIG. 7 is a side view of a third embodiment of the gear housing in FIG. 1.

A break away safety system according to a third embodiment of the gear housing 10 is shown in FIG. 7. The gear housing 10 includes a weakened region 78 in the form of an area made of a material of low strength, in this case a substitute piece made of plastic. Said substitute piece 78 can, for example, be attached to the gear housing 10 by means of an adhesive or fasteners such as rivets or screws or by welding or press fitting. The entire weakened region preferably consists of or comprises one continuous substitute piece 78, as this facilitates the assembly of the gear housing 10. However, solutions involving more than one substitute piece are possible, as are solutions wherein only a portion of the weakened region, e.g. the tail region, is replaced with a substitute piece. In the event or a collision, said substitute piece 78 will yield before the rest of the gear housing 10 and the hull 2, thus preventing severe damage from occurring to the hull 2. As before, the gear housing 10 is attached to the hull 2 via a fracturable member 14 adapted to fracture due to the concentration of loads that is the result of the collapse of the gear housing 10.

A number of variations and combinations are possible within the scope of the invention. The recesses can, for example, be formed in the outside surfaces of the gear housing, in which case they, in order to minimize the flow resistance, preferably are filled with a low strength material, such as plastic, adapted to yield before the rest of the gear housing.

Neither is the scope of the invention limited to the above described number of recesses, or the shown shapes of said recesses. The weakened region may comprise any number of recesses of any suitable shape. The weakened region may also comprise recesses located in the tail region.

Likewise, the tail region of the gear housing may be provided with any number of slits. Slits may also be present in other parts of the weakened region, for example in the side walls of a compartment, in which case they preferably are made airtight by means of some sort of sealing material. Also, a filler material can be used to completely fill the slits and recesses, to give the gear housing a more attractive appearance and to reduce the flow resistance. Furthermore, the slits may be located closer to the lower side of the gear housing as well as closer to the upper side of the gear housing than what is shown in the Figs.

As mentioned above, the weakened region may be located elsewhere in the gear housing, as long as it allows the impact receiving part of the gear housing to rotate relative the hull in the event of an impact. The weakened region may also be of different size or shape than the ones shown in the figures. A gear housing could also be provided with more than one weakened region.

The invention is also applicable to gear housings whose second portion consists of only one wall as seen in the thickness direction, or two walls that come together to form a single wall structure in this part of the housing. Such a gear housing may for example be provided with a weakened region comprising hollow portions. Any existing recesses are advantageously located in the outside surfaces of said gear housing.

The skilled person also realizes that the above described invention is not limited to aquatic vessels wherein the propellers are located in front of the gear housing. The invention is also applicable to vessels wherein the propellers have other locations, for example inside the gear housing or behind it. Accordingly, the particular propulsion arrangement shown in the figures is not limiting to the invention.

Finally, the scope of the invention covers all possible combinations of the above described embodiments. A gear housing according to the invention may, for example, be provided with one or more weakened regions comprising recesses as well as substitute pieces or portions of the housing that have been treated in order to have lowered strength, that is less resistance to compression.

The invention claimed is:

1. Gear housing for an aquatic vessel, the gear housing being attachable at an attachment site to an underside of a bull of the aquatic vessel, wherein the gear housing comprises at least one region that is weaker in strength relative to a surrounding area of the gear housing such that the region has an increased tendency, relative to the surrounding area, to yield in strength when the gear housing is rotated around the attachment site following an impact against a first end of the gear housing;

two side walls located opposite to one another so as to form a compartment; and a tail region where the side walls meet, the tail region being located at a second end of the gear housing, and the region comprising a slit dividing the tail region into a first and a second part, the first part exhibiting an oblique surface facing an oblique surface on the second part such that the first and second parts slide past one another following the impact.

2. Gear housing according to claim 1, wherein the region is located towards a second end of the gear housing situated opposite to a first end of the gear housing exposed to receive the impact.

3. Gear housing according to claim 1, wherein the gear housing comprises at least one wall and the region comprises at least one recess in the wall.

4. Gear housing according to claim 1, wherein the gear housing comprises two side walls located opposite to one another so as to form a compartment.

5. Gear housing according to claim 4, wherein inside surfaces of the side walls are provided with recesses.

6. Gear housing according to claim 1, wherein at least a portion of the region comprises a material having a greater tendency, relative to a neighboring portion of the region, to yield in strength when the gear housing is rotated at the attachment site following, the impact.

7. Gear housing according to claim 6, wherein the portion of the region comprises a material having a greater tendency, relative to a material forming the neighboring portion of the portion, to yield in strength when the gear housing is rotated at the attachment site following the impact.

8. Aquatic vessel comprising a gear housing according to claim 1.

9. Aquatic vessel according to claim 8, wherein the region yields in strength before the hull yields in strength.

10. Breakaway safety system for an aquatic vessel, the aquatic vessel comprising a hull, the breakaway safety system comprising:

a gear housing according to claim 1; and a fracturable member for attaching the gear housing to the bull at the attachment site;

wherein the region yields in strength such that the fracturable member fractures.

11. Aquatic vessel comprising a hull and a breakaway safety system, the breakaway safety system comprising:

a gear housing according to claim 1; and a fracturable member for attaching the gear housing to the hull at the attachment site;

wherein the region yields in strength such that the fracturable member fractures.

12. Aquatic vessel according to claim 11, wherein the region yields in strength before the hull yields in strength.

* * * * *